US006393394B1

(12) United States Patent
Ananthapadmanabhan et al.

(10) Patent No.: US 6,393,394 B1
(45) Date of Patent: May 21, 2002

(54) METHOD AND APPARATUS FOR INTERLEAVING LINE SPECTRAL INFORMATION QUANTIZATION METHODS IN A SPEECH CODER

(75) Inventors: Arasanipalai K. Ananthapadmanabhan; Sharath Manjunath, both of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/356,755

(22) Filed: Jul. 19, 1999

(51) Int. Cl.[7] ..... G10L 21/00; G10L 19/14; G10L 19/04; G10L 11/02

(52) U.S. Cl. ..... 704/230; 704/201; 704/200; 704/270; 704/222

(58) Field of Search ..... 704/223, 214, 704/222, 219, 220, 208, 230, 200, 201, 270

(56) References Cited

U.S. PATENT DOCUMENTS

| | | | | |
|---|---|---|---|---|
| 4,901,307 A | | 2/1990 | Gilhousen et al. | 370/18 |
| 5,103,459 A | | 4/1992 | Gilhousen et al. | 375/1 |
| 5,414,796 A | | 5/1995 | Jacobs et al. | 395/2.3 |
| 5,664,055 A | * | 9/1997 | Kroon | 704/223 |
| 5,699,485 A | * | 12/1997 | Shoham | 704/223 |
| 5,727,123 A | | 3/1998 | McDonough et al. | 395/2.33 |
| 5,732,389 A | * | 3/1998 | Kroon et al. | 704/223 |
| 5,911,128 A | | 6/1999 | DeJaco | 704/221 |

OTHER PUBLICATIONS

1978 Digital Processing of Speech Signals, "Linear Predictive Coding of Speech", L.R. Rabiner et al., pp. 396–453.
J.H.Y. Loo, et al., "Classified Nonlinear Predictive Vector Quantization of Speech Parameters," IEEE International Conference on Acoustics, Speech, and Signal Processing Conference Proceedings, Atlanta, GA, USA. 1996.
J. Skoglund, et al., "Predicitve VQ for Noisy Channel Spectrum Coding: AR of MA?" IEEE International Conference on Acoustics, Speech, and Signal Processing (ICASSP) US, Los Alamitos, IEEE Comp. Soc. Press. Apr. 21, 1997.

* cited by examiner

*Primary Examiner*—Richemond Dorvil
*Assistant Examiner*—Daniel A. Nolan
(74) *Attorney, Agent, or Firm*—Philip Wadsworth; Kent D. Baker; Thomas R. Rouse

(57) ABSTRACT

A method and apparatus for interleaving line spectral information quantization methods in a speech coder includes quantizing line spectral information with two vector quantization techniques, the first technique being a non-moving-average prediction-based technique, and the second technique being a moving-average prediction-based technique. A line spectral information vector is vector quantized with the first technique. Equivalent moving average codevectors for the first technique are computed. A memory of a moving average codebook of codevectors is updated with the equivalent moving average codevectors for a predefined number of frames that were previously processed by the speech coder. A target quantization vector for the second technique is calculated based on the updated moving average codebook memory. The target quantization vector is vector quantized with the second technique to generate a quantized target codevector. The memory of the moving average codebook is updated with the quantized target codevector. Quantized line spectral information vectors are derived from the quantized target codevector.

20 Claims, 7 Drawing Sheets

METHOD AND APPARATUS FOR INTERLEAVING LINE SPECTRAL INFORMATION QUANTIZATION METHODS IN A SPEECH CODER

BACKGROUND OF THE INVENTION

I. Field of the Invention

The present invention pertains generally to the field of speech processing, and more specifically to methods and apparatus for quantizing line spectral information in speech coders.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices for compressing speech find use in many fields of telecommunications. An exemplary field is wireless communications. The field of wireless communications has many applications including, e.g., cordless telephones, paging, wireless local loops, wireless telephony such as cellular and PCS telephone systems, mobile Internet Protocol (IP) telephony, and satellite communication systems. A particularly important application is wireless telephony for mobile subscribers.

Various over-the-air interfaces have been developed for wireless communication systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, IS-95B, proposed third generation standards IS-95C and IS2000, etc. (referred to collectively herein as IS-95), are promulgated by the Telecommunication Industry Association (TIA) and other well known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307, which are assigned to the assignee of the present invention and fully incorporated herein by reference.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Perhaps most important in the design of a speech coder is the search for a good set of parameters (including vectors) to describe the speech signal. A good set of parameters requires a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_o$, for each frame) or at a variable rate (in which different bit rates are used for different types of frame contents). Variable-rate coders attempt to use only the amount of bits needed to encode the code parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_o$, per frame to preserve the accuracy of the time-domain speech waveform. Such coders typically deliver excellent voice quality provided the number of bits, $N_o$, per frame relatively large (e.g., 8 kbps or above). However, at low bit rates (4 kbps and below), time-domain coders fail to retain high quality and robust performance due to the limited number of available bits. At low bit rates, the limited codebook space clips the waveform matching capability of conventional time-domain coders, which are so successfully deployed in higher-rate commercial applications. Hence, despite improvements over time, many CELP coding systems operating at low bit rates suffer from perceptually significant distortion typically characterized as noise.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. application Ser. No. 09/217,341, entitled *VARIABLE RATE SPEECH CODING*, filed Dec. 21, 1998, assigned to the assignee of the present invention, and fully incorporated herein by reference. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation.

In many conventional speech coders, line spectral information such as line spectral pairs or line spectral cosines is transmitted without exploiting the steady-state nature of voiced speech by encoding voiced speech frames without reducing the coding rate sufficiently. Hence, valuable bandwidth is wasted. In other conventional speech coders, multimode speech coders, or low-bit-rate speech coders, the steady-state nature of voiced speech is exploited for every frame. Accordingly, nonsteady-state frames degrade, and voice quality suffers.

The present invention is directed to a speech coder that uses multiple vector quantization methods to adapt to changes between periodic frames and nonperiodic frames. Accordingly, in one aspect of the invention, a speech coder advantageously includes a linear predictive filter configured to analyze a frame and generate a line spectral information codevector based thereon; and a quantizer coupled to the linear predictive filter and configured to vector quantize the line spectral information vector with a first vector quantization technique that uses a non-moving-average prediction-based vector quantization scheme, wherein the quantizer is further configured to compute equivalent moving average codevectors for the first technique, update with the equivalent moving average codevectors a memory of a moving average codebook of codevectors for a predefined number of frames that were previously processed by the speech coder, compute a target quantization vector for the second technique based on the updated moving average codebook memory, vector quantize the target quantization vector with a second vector quantization technique to generate a quantized target codevector, the second vector quantization technique using a moving-average predictionbased scheme, update the memory of the moving average codebook with the quantized target codevector, and compute quantized line spectral information vectors from the quantized target codevector.

It would be advantageous to provide an adaptive coding method that reacts to the nature of the speech content of each frame. Additionally, as the speech signal is generally nonsteady-state, or nonstationary, the efficiency of quantization of the line spectral information (LSI) parameters used in speech coding could be improved by employing a scheme in which the LSI parameters of each frame of speech are selectively coded either using moving-average (MA) prediction-based vector quantization (VQ) or using other standard VQ methods. Such a scheme would suitably exploit the advantages of either of the above two methods of VQ. Hence, it would be desirable to provide a speech coder that interleaves the two methods of VQ by appropriately mixing the two schemes at the boundaries of transitions from one method to the other. Thus, there is a need for a speech coder that uses multiple vector quantization methods to adapt to changes between periodic frames and nonperiodic frames.

SUMMARY OF THE INVENTION

The present invention is directed to a speech coder that uses multiple vector quantization methods to adapt to changes between periodic frames and nonperiodic frames. Accordingly, in one aspect of the invention, a speech coder advantageously includes a linear predictive filter configured to analyze a frame and generate a line spectral information codevector based thereon; and a quantizer coupled to the linear predictive filter and configured to vector quantize the line spectral information vector with a first vector quantization technique that uses a non-moving-average prediction-based vector quantization scheme, wherein the quantizer is further configured to compute equivalent moving average codevectors for the first technique, update with the equivalent moving average codevectors a memory of a moving average codebook of codevectors for a predefined number of frames that were previously processed by the speech coder, compute a target quantization vector for the second technique based on the updated moving average codebook memory, vector quantize the target quantization vector with a second vector quantization technique to generate a quantized target codevector, the second vector quantization technique using a moving-average prediction-based scheme, update the memory of the moving average codebook with the quantized target codevector, and compute quantized line spectral information vectors from the quantized target codevector.

In another aspect of the invention, a method of vector quantizing a line spectral information vector of a frame, using first and second quantization vector quantization techniques, the first technique using a non-moving-average prediction-based vector quantization scheme, the second technique using a moving-average prediction-based vector quantization scheme, advantageously includes the steps of vector quantizing the line spectral information vector with the first vector quantization technique; computing equivalent moving average codevectors for the first technique; updating with the equivalent moving average codevectors a memory of a moving average codebook of codevectors for a predefined number of frames that were previously processed by the speech coder; calculating a target quantization vector for the second technique based on the updated moving average codebook memory; vector quantizing the target quantization vector with the second vector quantization technique to generate a quantized target codevector; updating the memory of the moving average codebook with the quantized target codevector; and deriving quantized line spectral information vectors from the quantized target codevector.

In another aspect of the invention, a speech coder advantageously includes means for vector quantizing a line spectral information vector of a frame with a first vector quantization technique that uses a non-movingaverage prediction-based vector quantization scheme; means for computing equivalent moving average codevectors for the first technique; means for updating with the equivalent moving average codevectors a memory of a moving average codebook of codevectors for a predefined number of frames that were previously processed by the speech coder; means for calculating a target quantization vector for the second technique based on the updated moving average codebook memory; means for vector quantizing the target quantization vector with the second vector quantization technique to generate a quantized target codevector; means for updating the memory of the moving average codebook with the quantized target codevector; and means for deriving quantized line spectral information vectors from the quantized target codevector.

DETAILED DESCRIPTION OF THE PREFERRED EMBODIMENTS

The exemplary embodiments described hereinbelow reside in a wireless telephony communication system configured to employ a CDMA over-the-air interface. Nevertheless, it would be understood by those skilled in the art that a subsampling method and apparatus embodying features of the instant invention may reside in any of various communication systems employing a wide range of technologies known to those of skill in the art.

Figure 1:
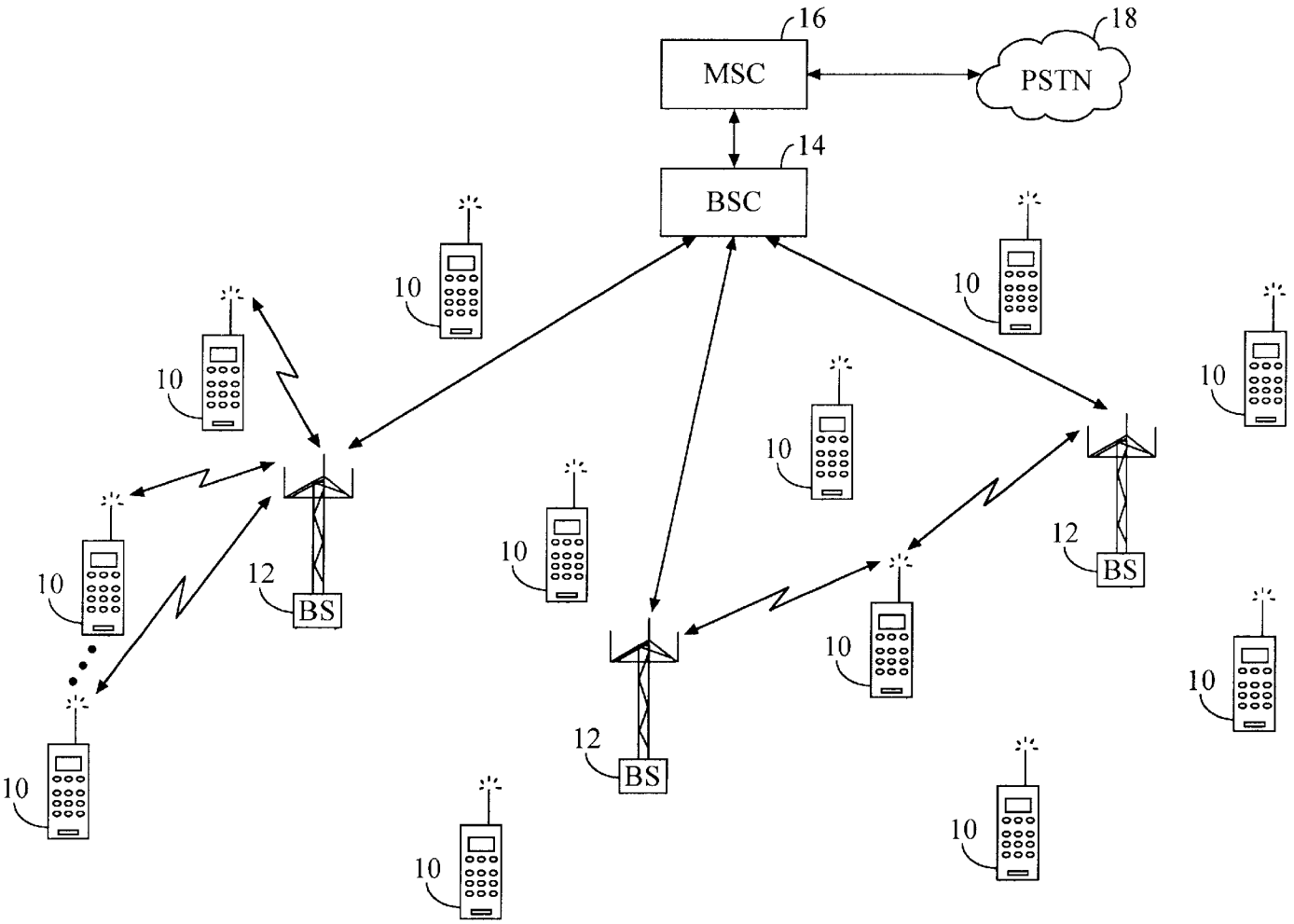
FIG. 1 PRIOR ART
FIG. 1 is a block diagram of a wireless telephone system.

As illustrated in FIG. 1, a CDMA wireless telephone system generally includes a plurality of mobile subscriber units 10, a plurality of base stations 12, base station controllers (BSCs) 14, and a mobile switching center (MSC) 16. The MSC 16 is configured to interface with a conventional public switch telephone network (PSTN) 18. The MSC 16 is also configured to interface with the BSCs 14. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. It is understood that there may be more than two BSCs 14 in the system. Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 are typically cellular or PCS telephones 10. The system is advantageously configured for use in accordance with the IS-95 standard.

During typical operation of the cellular telephone system, the base stations 12 receive sets of reverse link signals from sets of mobile units 10. The mobile units 10 are conducting telephone calls or other communications. Each reverse link signal received by a given base station 12 is processed within that base station 12. The resulting data is forwarded to the BSCs 14. The BSCs 14 provides call resource allocation and mobility management functionality including the orchestration of soft handoffs between base stations 12. The BSCs 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile units 10.

Figure 2:
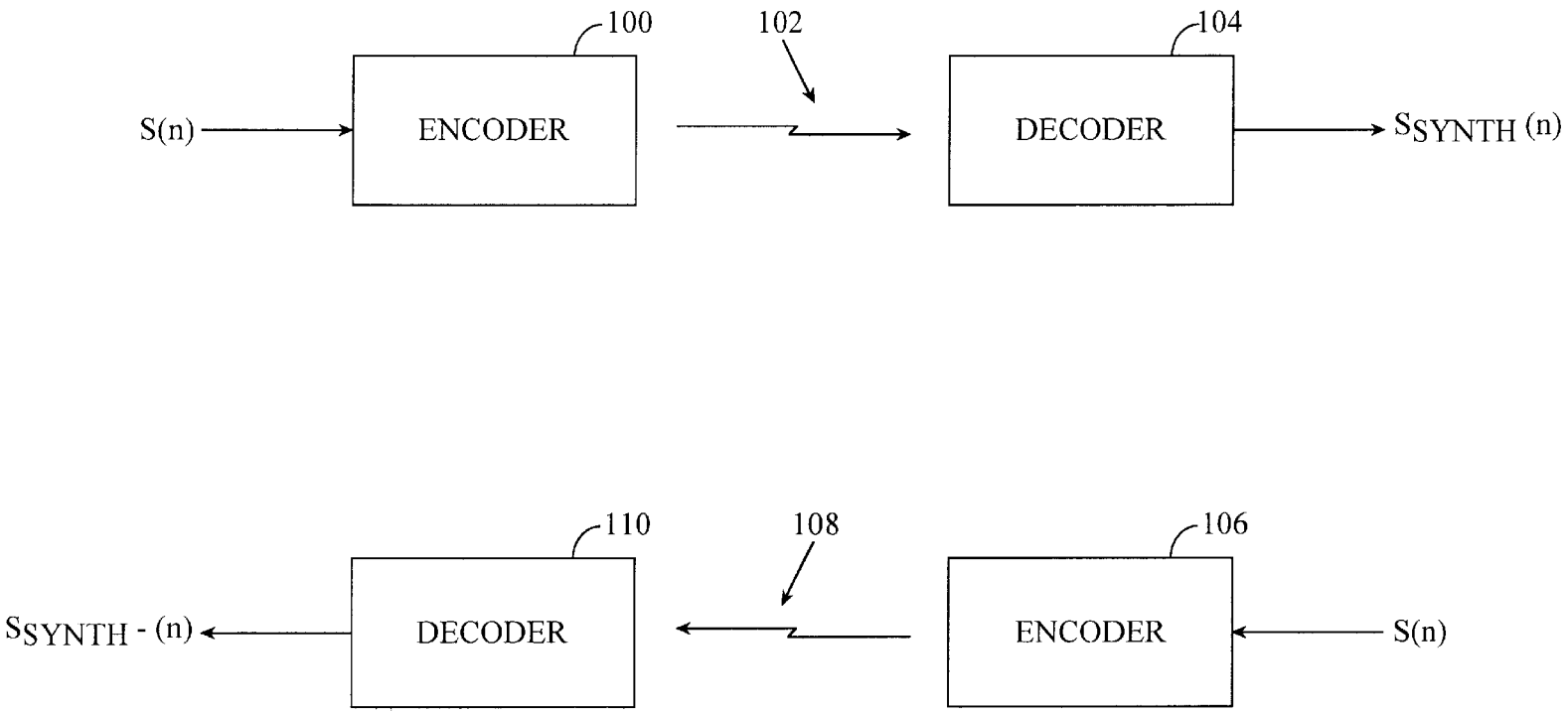
FIG. 2 PRIOR ART
FIG. 2 is a block diagram of a communication channel terminated at each end by speech coders.

In FIG. 2 a first encoder 100 receives digitized speech samples s(n) and encodes the samples s(n) for transmission on a transmission medium 102, or communication channel 102, to a first decoder 104. The decoder 104 decodes the encoded speech samples and synthesizes an output speech signal $s_{SYNTH}(n)$. For transmission in the opposite direction, a second encoder 106 encodes digitized speech samples s(n), which are transmitted on a communication channel 108. A second decoder 110 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), commanded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 100 and the second decoder 110 together comprise a first speech coder, or speech codec. The speech coder could be used in any communication device for transmitting speech signals, including, e.g., the subscriber units, BTSs, or BSCs described above with reference to FIG. 1. Similarly, the second encoder 106 and the first decoder 104 together comprise a second speech coder. It is understood by those of skill in the art that speech coders may be implemented with a digital signal processor (DSP), an applicationspecific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. application Ser. No. 08/197,417, now U.S. Pat. No. 5,784,532, entitled *VOCODER ASIC*, filed Feb. 16, 1994, assigned to the assignee of the present invention, and fully incorporated herein by reference.

Figure 3:
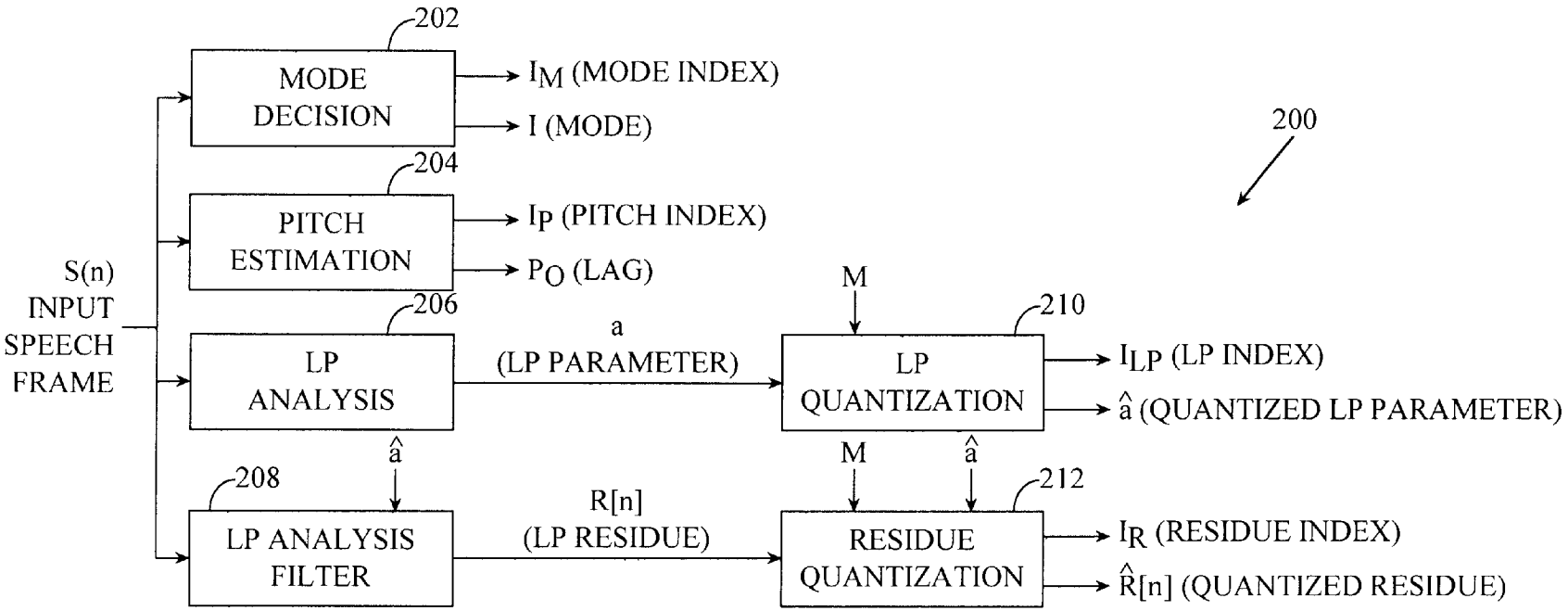
FIG. 3 PRIOR ART
FIG. 3 is a block diagram of an encoder.

In FIG. 3 an encoder 200 that may be used in a speech coder includes a mode decision module 202, a pitch estimation module 204, an LP analysis module 206, an LP analysis filter 208, an LP quantization module 210, and a residue quantization module 212. Input speech frames s(n) are provided to the mode decision module 202, the pitch estimation module 204, the LP analysis module 206, and the LP analysis filter 208. The mode decision module 202 produces a mode index $I_M$ and a mode M based upon the periodicity, energy, signal-to-noise ratio (SNR), or zero crossing rate, among other features, of each input speech frame s(n). Various methods of classifying speech frames according to periodicity are described in U.S. Pat. No. 5,911,128, which is assigned to the assignee of the present invention and fully incorporated herein by reference. Such methods are also incorporated into the Telecommunication Industry Association Industry Interim Standards TIA/EIA IS-127 and TIA/EIA IS-733. An exemplary mode decision scheme is also described in the aforementioned U.S. application Ser. No. 09/217,341.

The pitch estimation module 204 produces a pitch index $I_P$ and a lag value $P_0$ based upon each input speech frame s(n). The LP analysis module 206 performs linear predictive analysis on each input speech frame s(n) to generate an LP parameter a. The LP parameter a is provided to the LP quantization module 210. The LP quantization module 210 also receives the mode M, thereby performing the quantization process in a mode-dependent manner. The LP quantization module 210 produces an LP index $I_{LP}$ and a quantized LP parameter â. The LP analysis filter 208 receives the quantized LP parameter â in addition to the input speech frame s(n). The LP analysis filter 208 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 212. Based upon these values, the residue quantization module 212 produces a residue index $I_R$ and a quantized residue signal R̂[n].

Figure 4:
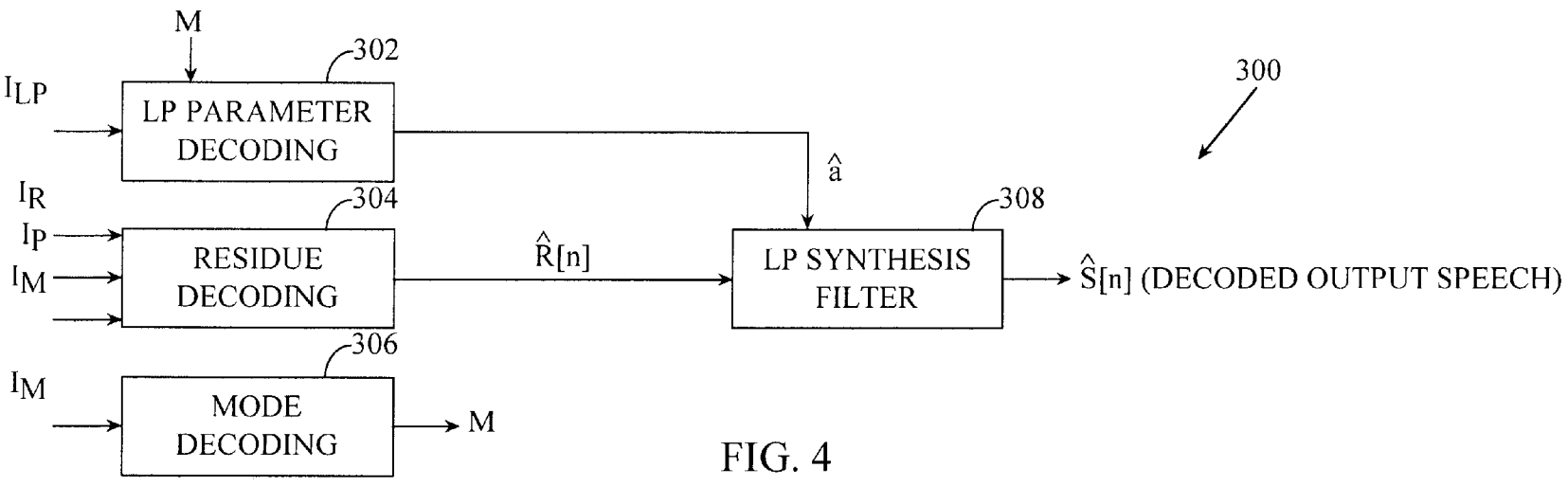
FIG. 4 PRIOR ART
FIG. 4 is a block diagram of a decoder.

In FIG. 4 a decoder 300 that may be used in a speech coder includes an LP parameter decoding module 302, a residue decoding module 304, a mode decoding module 306, and an LP synthesis filter 308. The mode decoding module 306 receives and decodes a mode index $I_M$, generating therefrom a mode M. The LP parameter decoding module 302 receives the mode M and an LP index $I_{LP}$. The LP parameter decoding module 302 decodes the received values to produce a quantized LP parameter â. The residue decoding module 304 receives a residue index $I_R$, a pitch index $I_P$, and the mode index $I_M$. The residue decoding module 304 decodes the received values to generate a quantized residue signal R̂[n]. The quantized residue signal R̂[n] and the quantized LP parameter â are provided to the LP synthesis filter 308, which synthesizes a decoded output speech signal ŝ[n] therefrom.

Operation and implementation of the various modules of the encoder 200 of FIG. 3 and the decoder 300 of FIG. 4 are known in the art and described in the aforementioned U.S. Pat. No. 5,414,796 and L. B. Rabiner & R. W. Schafer, *Digital Processing of Speech Signals* 396–453 (1978).

Figure 5:
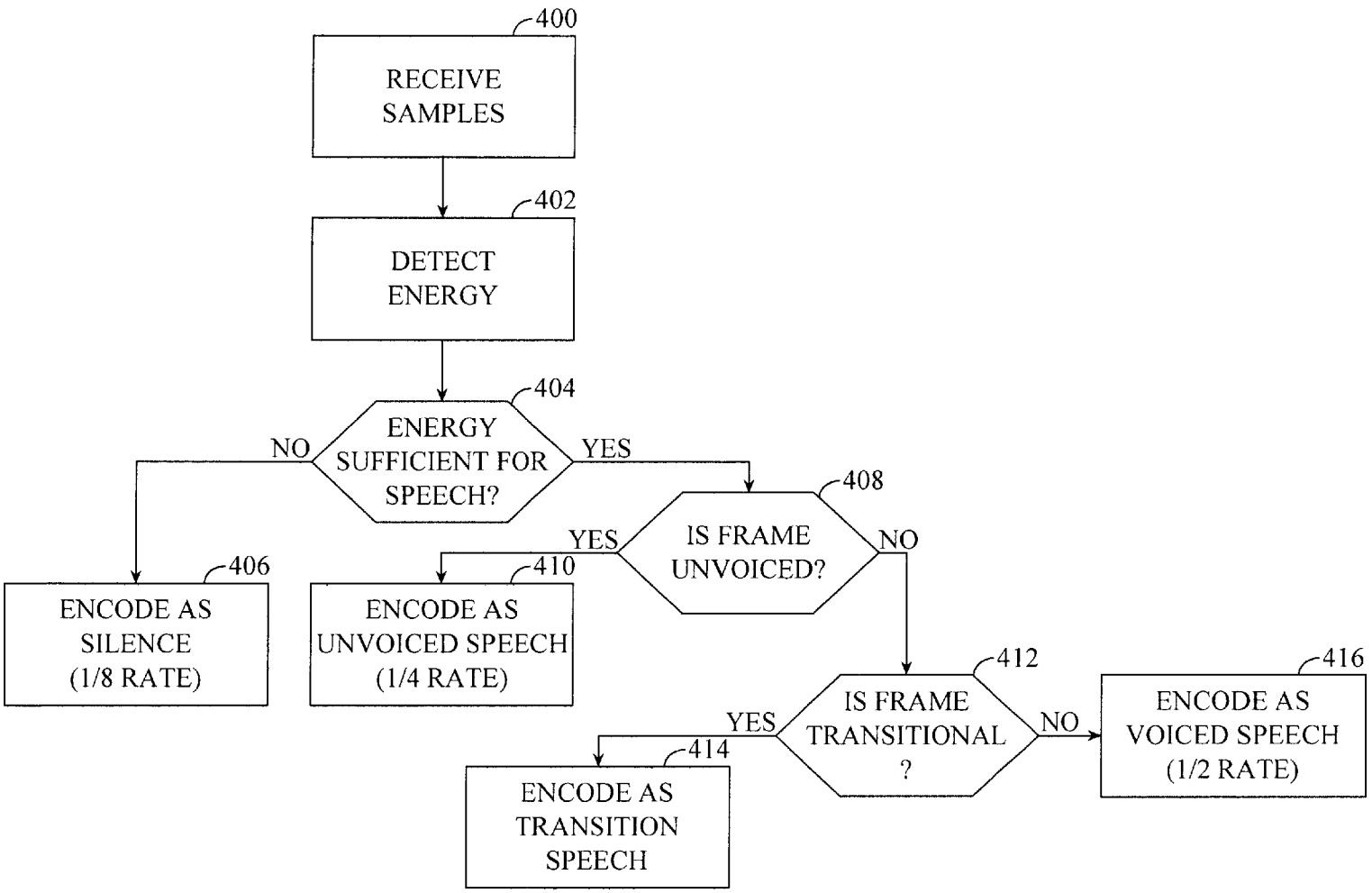
FIG. 5 is a flow chart illustrating a speech coding decision process.

As illustrated in the flow chart of FIG. 5, a speech coder in accordance with one embodiment follows a set of steps in processing speech samples for transmission. In step 400 the speech coder receives digital samples of a speech signal in successive frames. Upon receiving a given frame, the speech coder proceeds to step 402. In step 402 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 404. In step 404 the speech coder determines whether the detected frame energy is sufficient to classify the frame as containing speech information. If the detected frame energy falls below a predefined threshold level, the speech coder proceeds to step 406. In step 406 the speech coder encodes the frame as background noise (i.e., nonspeech, or silence). In one embodiment the background noise frame is encoded at ⅛ rate, or 1 kbps. If in step 404 the detected frame energy meets or exceeds the predefined threshold level, the frame is classified as speech and the speech coder proceeds to step 408.

In step 408 the speech coder determines whether the frame is unvoiced speech, i.e., the speech coder examines the periodicity of the frame. Various known methods of periodicity determination include, e.g., the use of zero crossings and the use of normalized autocorrelation functions (NACFs). In particular, using zero crossings and NACFs to detect periodicity is described in the aforementioned U.S. Pat. No. 5,911,128 and U.S. application Ser. No.

09/217,341. In addition, the above methods used to distinguish voiced speech from unvoiced speech are incorporated into the Telecommunication Industry Association Interim Standards TIA/EIA IS-127 and TIA/EIA IS-733. If the frame is determined to be unvoiced speech in step 408, the speech coder proceeds to step 410. In step 410 the speech coder encodes the frame as unvoiced speech. In one embodiment unvoiced speech frames are encoded at quarter rate, or 2.6 kbps. If in step 408 the frame is not determined to be unvoiced speech, the speech coder proceeds to step 412.

In step 412 the speech coder determines whether the frame is transitional speech, using periodicity detection methods that are known in the art, as described in, e.g., the aforementioned U.S. Pat. No. 5,911,128. If the frame is determined to be transitional speech, the speech coder proceeds to step 414. In step 414 the frame is encoded as transition speech (i.e., transition from unvoiced speech to voiced speech). In one embodiment the transition speech frame is encoded in accordance with a multipulse interpolative coding method described in U.S. application Ser. No. 09/307,294, now U.S. Pat. No. 6,260,017, entitled *MULTI-PULSE INTERPOLATIVE CODING OF TRANSITION SPEECH FRAMES*, filed May 7, 1999, assigned to the assignee of the present invention, and fully incorporated herein by reference. In another embodiment the transition speech frame is encoded at full rate, or 13.2 kbps.

If in step 412 the speech coder determines that the frame is not transitional speech, the speech coder proceeds to step 416. In step 416 the speech coder encodes the frame as voiced speech. In one embodiment voiced speech frames may be encoded at half rate, or 6.2 kbps. It is also possible to encode voiced speech frames at full rate, or 13.2 kbps (or full rate, 8 kbps, in an 8 k CELP coder). Those skilled in the art would appreciate, however, that coding voiced frames at half rate allows the coder to save valuable bandwidth by exploiting the steady-state nature of voiced frames. Further, regardless of the rate used to encode the voiced speech, the voiced speech is advantageously coded using information from past frames, and is hence said to be coded predictively.

Figure 6A:
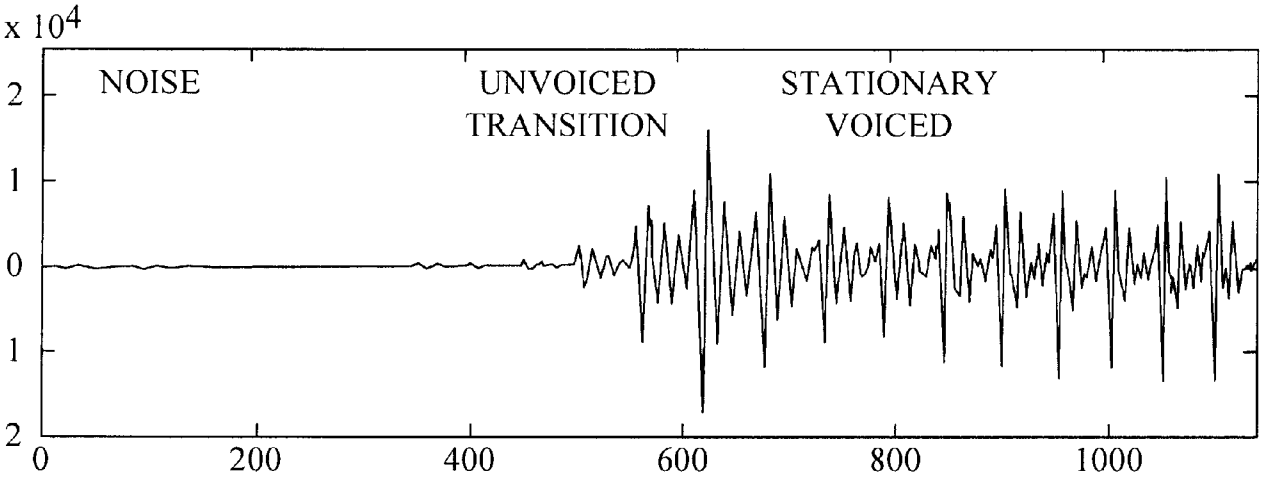
FIG. 6A is a graph speech signal amplitude versus time.
Figure 6B:
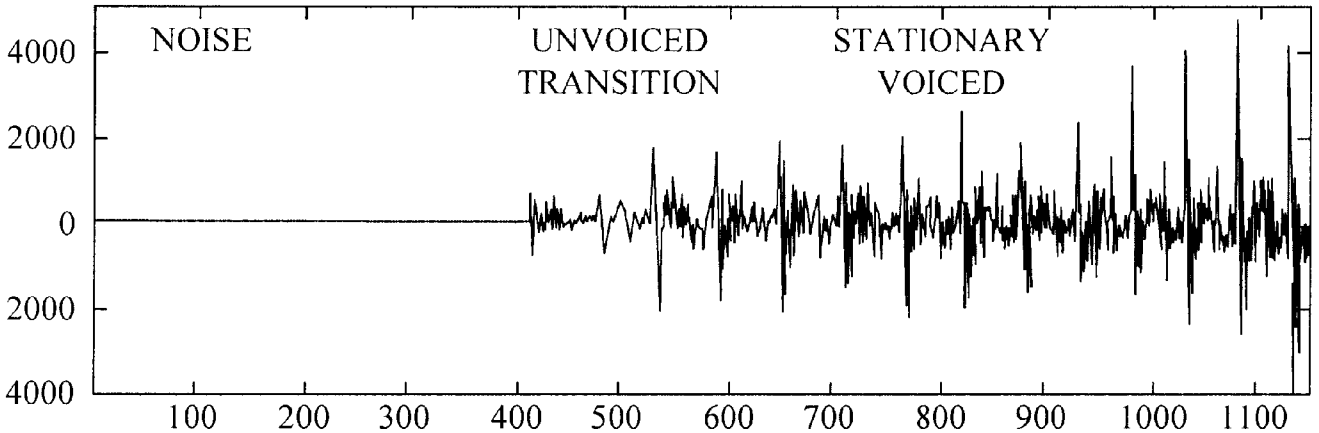
FIG. 6B is a graph of linear prediction (LP) residue amplitude versus time.

Those of skill would appreciate that either the speech signal or the corresponding LP residue may be encoded by following the steps shown in FIG. 5. The waveform characteristics of noise, unvoiced, transition, and voiced speech can be seen as a function of time in the graph of FIG. 6A. The waveform characteristics of noise, unvoiced, transition, and voiced LP residue can be seen as a function of time in the graph of FIG. 6B.

Figure 7:
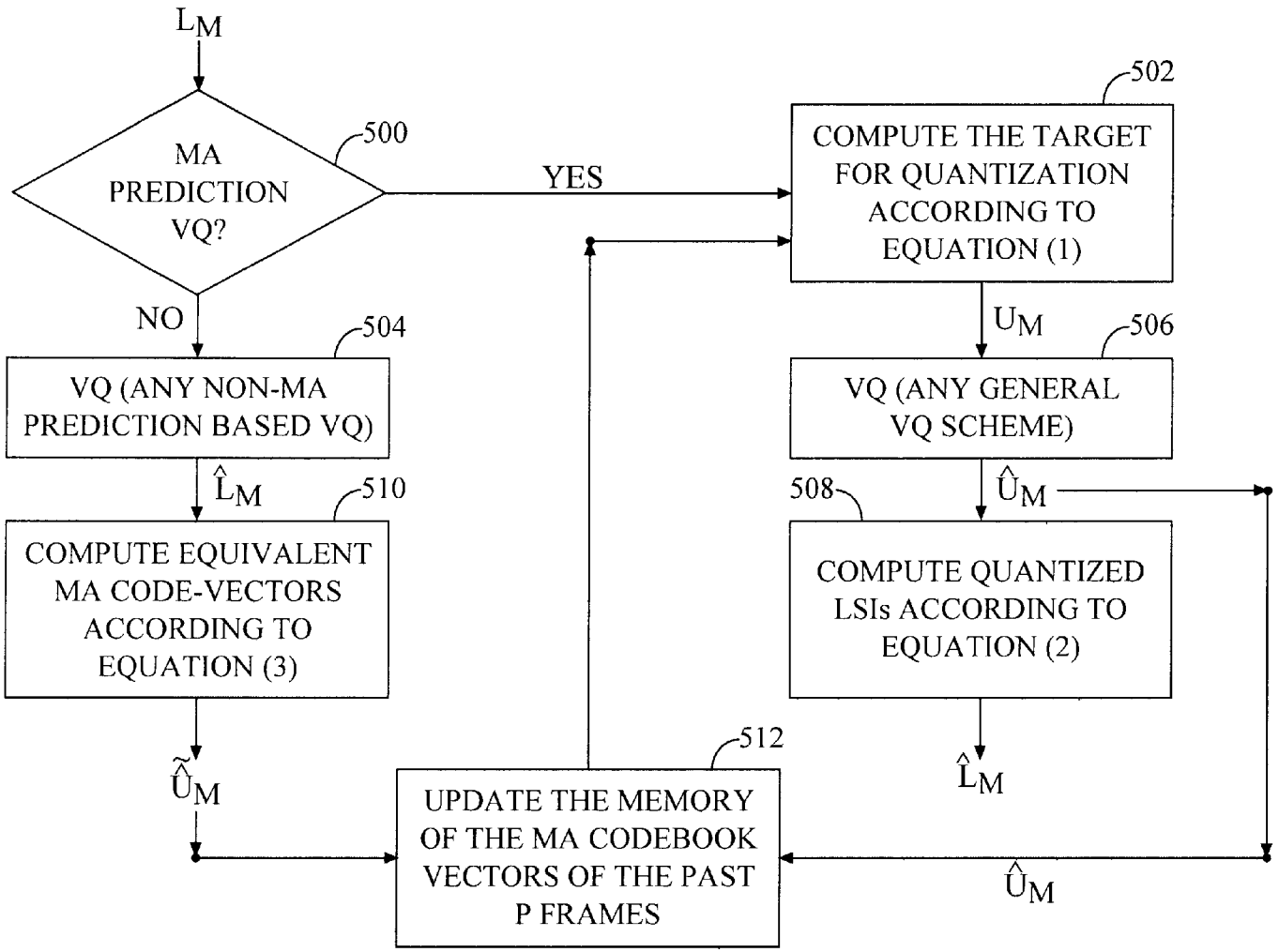
FIG. 7 is a flow chart illustrating method steps performed by a speech coder to interleave two methods of line spectral information (LSI) vector quantization (VQ).

In one embodiment a speech coder performs the algorithm steps shown in the flow chart of FIG. 7 to interleave two methods of line spectral information (LSI) vector quantization (VQ). The speech coder advantageously computes estimates of the equivalent moving-average (MA) codebook vector for non-MA prediction-based LSI VQ, which enables the speech coder to interleave two methods of LSI VQ. In an MA prediction-based scheme, an MA is calculated for a previously processed number of frames, P, the MA being computed by multiplying parameter weights by respective vector codebook entries, as described below. The MA is subtracted from the input vector of LSI parameters to generate a target quantization vector, also as described below. It would be readily appreciated by those skilled in the art that the non-MA prediction-based VQ method may be any known method of VQ that does not employ an MA prediction-based VQ scheme.

The LSI parameters are typically quantized, either by using VQ with interframe MA prediction or by using any other standard non MA-prediction based VQ method such as, e.g., split VQ, multistage VQ (MSVQ), switched predictive VQ (SPVQ), or a combination of some or all of these. In the embodiment described with reference to FIG. 7, a scheme is employed to mix any of the above-mentioned methods of VQ with an MA prediction-based VQ method. This is desirable because while an MA prediction-based VQ method is used to best advantage for speech frames that are steady-state, or stationary, in nature (which exhibit signals such as those shown for stationary voiced frames in FIGS. 6A–B), a non-MA prediction-based VQ method is used to best advantage for speech frames that are nonsteady-state, or nonstationary, in nature (which exhibit signals such as those shown for unvoiced frames and transition frames in FIGS. 6A–B).

In non-MA prediction-based VQ schemes for quantizing the N-dimensional LSI parameters, the input vector for the $M^{th}$ frame, $L_M \equiv \{L_M^n; n=0,1,\ldots,N-1\}$, is used directly as the target for quantization and is quantized to the vector $\hat{L}_M \equiv \{\hat{L}_M^n; n=0,1,\ldots,N-1\}$ using any of the standard VQ techniques mentioned above.

In the exemplary interframe MA prediction scheme, the target for quantization is computed as $$U_M \equiv \left\{ U_M^n = \frac{\left(L_M^n - \alpha_1^n \hat{U}_{M-1}^n - \alpha_2^n \hat{U}_{M-2}^n - \ldots - \alpha_2^n \hat{U}_{M-P}^n\right)}{\alpha_0^n}; \quad n = 0, 1, \ldots, N-1 \right\} \tag{1}$$

where $\{\hat{U}_{M-1}^n, \hat{U}_{M-2}^n, \ldots, \hat{U}_{M-P}^n; n-0,1,\ldots,N-1\}$ are the codebook entries corresponding to the LSI parameters of P frames immediately prior to frame M, and $\{\alpha_1^n, \alpha_2^n, \ldots, \alpha_p^n; n=0,1,\ldots,N-1\}$ are the respective weights such that $\{\alpha_0^n+\alpha_1^n+, \ldots, +\alpha_p^n=1; n=0,1,\ldots,N-1\}$. The target quantization $U_M$ is then quantized to $\hat{U}_M$ using any of the VQ techniques mentioned above. The quantized LSI vector is computed as follows:

$$\hat{L}_M \equiv \{\hat{L}_m^n = \alpha_0^n \hat{U}_M^n + \alpha_1^n \hat{U}_{M-1}^n + \ldots + \alpha_p^n \hat{U}_{M-P}^n;\ n=0,1,\ldots,N-1\} \tag{2}$$

The MA prediction scheme requires the presence of the past values of the codebook entries, $\{\hat{U}_{M-1}, \hat{U}_{M-2}, \ldots, \hat{U}_{M-P}\}$, of the past P frames. While the codebook entries are automatically available for those frames (among the past P frames) that were themselves quantized using the MA scheme, the remainder of the past P frames could have been quantized using a non-MA prediction-based VQ method, and the corresponding codebook entries ($\hat{U}$) are not directly available for these frames. This makes it difficult to mix, or interleave, the above two methods of VQ.

In the embodiment described with reference to FIG. 7, the following equation is advantageously used to compute estimates, $\tilde{\hat{U}}_{M-K}$, of the codebook entry $\hat{U}_{M-K}$ in cases of $K \in \{1,2, \ldots, P\}$ where the codebook entry $\hat{U}_{M-K}$ is not explicitly available:

$$\tilde{\hat{U}}_{M-K} \equiv \left\{ \tilde{\hat{U}}^{n}_{M-K} = \frac{\left(\hat{L}^{n}_{M-R} - \beta^{n}_{1}\hat{U}^{n}_{M-K-1} - \beta^{n}_{2}\hat{U}^{n}_{M-K-2} - \ldots - \beta^{n}_{R}\hat{U}^{n}_{M-K-P}\right)}{\beta^{n}_{0}}; \quad n = 0, 1, \ldots, N-1 \right\} \tag{3}$$

where $\{\beta_1^n, \beta_2^n, \ldots, \beta_p^n; n=0,1, \ldots, N-1\}$ are the respective weights such that $\{\beta_0^n + \beta_1^n +, \ldots + \beta_p^n = 1; n=0,1, \ldots, N-1\}$, and with the initial condition of $\{\tilde{\hat{U}}_{-1}, \tilde{\hat{U}}_{-2}, \ldots, \tilde{\hat{U}}_{-P}\}$. An exemplary initial condition is $\{\tilde{\hat{U}}_{-1} = \tilde{\hat{U}}_{-2} =, \ldots, = \tilde{\hat{U}}_{-P} = L^B\}$, where $L^B$ are the bias values of the LSI parameters. The following is an exemplary set of weights:

$$\left\{ \begin{matrix} \beta^{n}_{0} = 1; \\ \beta^{n}_{1} =, \ldots, = \beta^{n}_{P} = 0; \end{matrix} \right\} n = 0, 1, \ldots, N-1 \}.$$

In step 500 of the flow chart of FIG. 7, the speech coder determines whether to quantize the input LSI vector $L_M$ with an MA prediction-based VQ technique. This decision is advantageously based upon the speech content of the frame. For example, LSI parameters for stationary voiced frames are quantized to best advantage with an MA prediction-based VQ method, while LSI parameters for unvoiced frames and transition frames are quantized to best advantage with a non-MA prediction-based VQ method. If the speech coder decides to quantize the input LSI vector $L_M$ with an MA prediction-based VQ technique, the speech coder proceeds to step 502. If, on the other hand, the speech coder decides not to quantize the input LSI vector $L_M$ with an MA prediction-based VQ technique, the speech coder proceeds to step 504.

In step 502 the speech coder computes the target $U_M$ for quantization in accordance with equation (1) above. The speech coder then proceeds to step 506. In step 506 the speech coder quantizes the target $U_M$ in accordance with any of various general VQ techniques that are well known in the art. The speech coder then proceeds to step 508. In step 508 the speech coder computes the vector $\hat{L}_M$ of quantized LSI parameters from the quantized target $\hat{U}_M$ in accordance with equation (2) above.

In step 504 the speech coder quantizes the target $L_M$ in accordance with any of various non-MA prediction-based VQ techniques that are well known in the art. (As those skilled in the art would understand, the target vector for quantization in a non-MA prediction-based VQ technique is $L_M$, and not $U_M$.) The speech coder then proceeds to step 510. In step 510 the speech coder computes equivalent MA codevectors $\tilde{\hat{U}}_M$ from the vector $\hat{L}_M$ of quantized LSI parameters in accordance with equation (3) above.

In step 512 the speech coder uses the quantized target $\hat{U}_M$ obtained in step 506 and the equivalent MA codevectors $\tilde{\hat{U}}_M$ obtained in step 510 to update the memory of the MA codebook vectors of the past P frames. The updated memory of the MA codebook vectors of the past P frames is then used in step 502 to compute the target $U_M$ for quantization for the input LSI vector $L_{M+1}$ for the next frame.

Thus, a novel method and apparatus for interleaving line spectral information quantization methods in a speech coder has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A speech coder, comprising:

a linear predictive filter configured to analyze a frame and generate a line spectral information codevector based thereon; and a quantizer coupled to the linear predictive filter and configured to vector quantize the line spectral information vector with a first vector quantization technique that uses a non-moving-average prediction-based vector quantization scheme, wherein the quantizer is further configured to compute equivalent moving average codevectors for the first technique;

update a moving average codebook of codevectors for a predefined number of frames that were previously processed by the speech coder with the equivalent moving average codevectors;

compute a target quantization vector for the second technique based on the updated moving average codebook memory;

vector quantize the target quantization vector with a second vector quantization technique to generate a quantized target codevector;

the second vector quantization technique using a moving-average prediction-based scheme;

update the memory of the moving average codebook with the quantized target codevector;

and compute quantized line spectral information vectors from the quantized target codevector.

2. The speech coder of claim 1, wherein the frame is a frame of speech.

3. The speech coder of claim 1, wherein the frame is a frame of linear prediction residue.

4. The speech coder of claim 1, wherein the target quantization vector is computed in accordance with the following equation:

$$U_M \equiv \left\{ U_M^n = \frac{\left(L_M^n - \alpha_1^n \hat{U}_{M-1}^n - \alpha_2^n \hat{U}_{M-2}^n - \ldots - \alpha_P^n \hat{U}_{M-P}^n\right)}{\alpha_0^n}; \quad n = 0, 1, \ldots, N-1 \right\},$$

wherein $\{\hat{U}_{M-1}^n, \hat{U}_{M-2}^n, \ldots, \hat{U}_{M-P}^n; n=0,1, \ldots, N-1\}$ are codebook entries corresponding to line spectral information parameters of the predefined number of frames processed immediately prior to the frame, and $\{\alpha_1^n, \alpha_2^n, \ldots, \alpha_P^n; n=0,1, \ldots, N-1\}$ are respective parameter weights such that $\{\alpha_0^n + \alpha_1^n +, \ldots, + \alpha_P^n = 1; n=0,1, \ldots, N-1\}$.

5. The speech coder of claim 1, wherein the quantized line spectral information vectors are computed in accordance with the following equation:

$$\hat{L}_M \equiv \{\hat{L}_M^n = \alpha_0^n \hat{U}_M^n + \alpha_1^n \hat{U}_{M-1}^n + \ldots + \alpha_P^n \hat{U}_{M-P}^n; n=0,1, \ldots, N-1\},$$

wherein $\{\hat{U}_{M-1}^n, \hat{U}_{M-2}^n, \ldots, \hat{U}_{M-P}^n; n=0,1, \ldots, N-1\}$ are codebook entries corresponding to line spectral information parameters of the predefined number of frames processed immediately prior to the frame, and $\{\alpha_1^n, \alpha_2^n, \ldots, \alpha_P^n; n=0,1, \ldots, N-1\}$ are respective parameter weights such that $\{\alpha_0^n + \alpha_1^n, \ldots, \alpha_P^n; n=0,1, \ldots, N-1\}$.

6. The speech coder of claim 1, wherein the equivalent moving average codevectors are computed in accordance with the following equation:

$$\tilde{\hat{U}}_{M-K} \equiv \left\{ \tilde{\hat{U}}_{M-K}^n = \frac{\left(\hat{L}_{M-R}^n - \beta_1^n \hat{U}_{M-K-1}^n - \beta_2^n \hat{U}_{M-K-2}^n - \ldots - \beta_R^n \hat{U}_{M-K-P}^n\right)}{\beta_0^n}; \quad n = 0, 1, \ldots, N-1 \right\},$$

wherein $\{\beta_1^n, \beta_2^n, \ldots, \beta_P^n; n=0,1, \ldots, N-1\}$ are respective equivalent moving average codevector element weights such that $\{\beta_0^n + \beta_1^n +, \ldots, + \beta_P^n = 1; n=0,1, \ldots, N-1\}$, and wherein an initial condition of $\{\tilde{\hat{U}}_{-1}, \tilde{\hat{U}}_{-2}, \ldots, \tilde{\hat{U}}_{-P}\}$ is established.

7. The speech coder of claim 1, wherein the speech coder resides in a subscriber unit of a wireless communication system.

8. A method of vector quantizing a line spectral information vector of a frame, using first and second quantization vector quantization techniques, the first technique using a non-moving-average prediction-based vector quantization scheme, the second technique using a moving-average prediction-based vector quantization scheme, the method comprising the steps of:

vector quantizing the line spectral information vector with the first vector quantization technique;

computing equivalent moving average codevectors for the first technique;

updating with the equivalent moving average codevectors a memory of a moving average codebook of codevectors for a predefined number of previously processed frames;

calculating a target quantization vector for the second technique based on the updated moving average codebook memory;

vector quantizing the target quantization vector with the second vector quantization technique to generate a quantized target codevector;

updating the memory of the moving average codebook with the quantized target codevector; and deriving quantized line spectral information vectors from the quantized target codevector.

9. The method of claim 8, wherein the frame is a frame of speech.

10. The method of claim 8, wherein the frame is a frame of linear prediction residue.

11. The method of claim 8, wherein the calculating step comprises calculating the target quantization in accordance with the following equation:

$$U_M \equiv \left\{ U_M^n = \frac{\left(L_M^n - \alpha_1^n \hat{U}_{M-1}^n - \alpha_2^n \hat{U}_{M-2}^n - \ldots - \alpha_P^n \hat{U}_{M-P}^n\right)}{\alpha_0^n}; \quad n = 0, 1, \ldots, N-1 \right\}.$$

wherein $\{\hat{U}_{M-1}^n, \hat{U}_{M-2}^n, \ldots, \hat{U}_{M-P}^n; n=0,1, \ldots, N-1\}$ are codebook entries corresponding to line spectral information parameters of the predefined number of frames processed immediately prior to the frame, and $\{\alpha_1^n, \alpha_2^n, \ldots, \alpha_P^n; n=0,1, \ldots, N-1\}$, are respective parameter weights such that $\{\alpha_0^n + \alpha_1^n +, \ldots, + \alpha_P^n = 1; n=0,1, \ldots, N-1\}$.

12. The method of claim 8, wherein the deriving step comprises deriving the quantized line spectral information vectors in accordance with the following equation:

$$\hat{L}_M \equiv \{\hat{L}_M^n = \alpha_0^n \hat{U}_M^n + \alpha_1^n \hat{U}_{M-1}^n + \ldots + \alpha_P^n \hat{U}_{M-P}^n; n=0,1, \ldots, n-1\},$$

wherein $\{\hat{U}_{M-1}^n, \hat{U}_{M-2}^n, \ldots, \hat{U}_{M-P}^n; n=0,1, \ldots, N-1\}$ are codebook entries corresponding to line spectral information parameters of the predefined number of frames processed immediately prior to the frame, and $\{\alpha_1^n, \alpha_2^n, \ldots, \alpha_P^n; n=0,1, \ldots, N-1\}$ are respective parameter weights such that $\{\alpha_0^n + \alpha_1^n +, \ldots, \alpha_P^n = 1; n=0,1, \ldots, N-1\}$.

13. The method of claim 8, wherein the computing step comprises computing the equivalent moving average codevectors in accordance with the following equation:

$$\tilde{\hat{U}}_{M-K} \equiv \left\{ \tilde{\hat{U}}_{M-K}^n = \frac{\left(\hat{L}_{M-R}^n - \beta_1^n \hat{U}_{M-K-1}^n - \beta_2^n \hat{U}_{M-K-2}^n - \ldots - \beta_R^n \hat{U}_{M-K-P}^n\right)}{\beta_0^n}; \quad n = 0, 1, \ldots, N-1 \right\}.$$

wherein $\{\beta_1^n, \beta_2^n, \ldots, \beta_P^n; n=0,1, \ldots, N-1\}$ are respective equivalent moving average codevector element weights such that $\{\beta_0^n + \beta_1^n +, \ldots, + \beta_P^n = 1; n=0,1, \ldots, N-1\}$, and wherein an initial condition of $\{\tilde{\hat{U}}_{-1}, \tilde{\hat{U}}_{-2}, \ldots, \tilde{\hat{U}}_{-P}\}$ is established.

14. A speech coder, comprising:

means for vector quantizing a line spectral information vector of a frame with a first vector quantization technique that uses a non-moving average prediction-based vector quantization scheme;

means for computing equivalent moving average codevectors for the first technique;

means for updating with the equivalent moving average codevectors a memory of a moving average codebook of codevectors for a predefined number of frames that were previously processed by the speech coder;

means for calculating a target quantization vector for the second technique based on the updated moving average codebook memory;

means for vector quantizing the target quantization vector with the second vector quantization technique to generate a quantized target codevector;

means for updating the memory of the moving average codebook with the quantized target codevector; and means for deriving quantized line spectral information vectors from the quantized target codevector.

15. The speech coder of claim 14, wherein the frame is a frame of speech.

16. The speech coder of claim 14, wherein the frame is a frame of linear prediction residue.

17. The speech coder of claim 14, wherein the target quantization is calculated in accordance with the following equation:

$$U_M \equiv \left\{ U_M^n = \frac{\left(L_M^n - \alpha_1^n \hat{U}_{M-1}^n - \alpha_2^n \hat{U}_{M-2}^n - \ldots - \alpha_P^n \hat{U}_{M-P}^n\right)}{\alpha_0^n}; \quad n = 0, 1, \ldots, N-1 \right\},$$

wherein $\{\hat{U}_{M-1}^n, \hat{U}_{M-2}^n, \ldots, \hat{U}_{M-P}^n; n=0,1, \ldots, N-1\}$ are codebook entries corresponding to line spectral information parameters of the predefined number of frames processed immediately prior to the frame, and $\{\alpha_1^n, \alpha_2^n, \ldots, \alpha_P^n; n=0,1, \ldots, N-1\}$ are respective parameter weights such that $\{\alpha_0^n + \alpha_1^n +, \ldots, +\alpha_P^n + 1; n=0,1, \ldots, N-1\}$.

18. The speech coder of claim 14, wherein the quantized line spectral information vectors are derived in accordance with the following equation:

$$\hat{L}_M \equiv \{\hat{L}_M^n = \alpha_0^n \hat{U}_M^n + \alpha_1^n \hat{U}_{M-1}^n + \ldots + \alpha_P^n \hat{U}_{M-P}^n; n=0,1, \ldots, N-1\},$$

wherein $\{\hat{U}_{M-1}^n, \hat{U}_{M-2}^n, \ldots, \hat{U}_{M-P}^n; n=0,1, \ldots, N-1\}$ are codebook entries corresponding to line spectral information parameters of the predefined number of frames processed immediately prior to the frame, and $\{\alpha_1^n, \alpha_2^n, \ldots, \alpha_P^n; n=0,1, \ldots, N-1\}$ are respective parameter weights such that $\{\alpha_0^n + \alpha_2^n +, \ldots, +\alpha_P^n = 1; n=0,1, \ldots, N-1\}$.

19. The speech coder of claim 14, wherein the equivalent moving average codevectors are computed in accordance with the following equation:

$$\tilde{U}_{M-K} \equiv \left\{ \tilde{\hat{U}}_{M-K}^n = \frac{\left(\hat{L}_{M-R}^n - \beta_1^n \hat{U}_{M-K-1}^n - \beta_2^n \hat{U}_{M-K-2}^n - \ldots - \beta_R^n \hat{U}_{M-K-P}^n\right)}{\beta_0^n}; \quad n = 0, 1, \ldots, N-1 \right\},$$

wherein $\{\beta_1^n, \beta_2^n, \ldots, \beta_P^n; n=0,1, \ldots, N-1\}$ are respective equivalent moving average codevector element weights such that $\{\beta_0^n + \beta_1^n +, \ldots, \beta_P^n = 1; n=0,1, \ldots, N-1\}$, and wherein an initial condition of $\{\tilde{\hat{U}}_{-1}, \tilde{\hat{U}}_{-2}, \ldots, \tilde{\hat{U}}_{-P}\}$ is established.

20. The speech coder of claim 14, wherein the speech coder resides in a subscriber unit of a wireless communication system.

* * * * *